US012702230B2

(12) United States Patent
Chen et al.

(10) Patent No.: US 12,702,230 B2
(45) Date of Patent: Aug. 11, 2026

(54) SLIDE RAIL MECHANISM

(71) Applicants: King Slide Works Co., Ltd., Kaohsiung City (TW); King Slide Technology Co., Ltd., Kaohsiung City (TW)

(72) Inventors: Ken-Ching Chen, Kaohsiung City (TW); Shun-Ho Yang, Kaohsiung City (TW); Kai-Wen Yu, Kaohsiung City (TW); Chun-Chiang Wang, Kaohsiung City (TW)

(73) Assignees: King Slide Works Co., Ltd., Kaohsiung City (TW); King Slide Technology Co., Ltd., Kaohsiung City (TW)

( * ) Notice: Subject to any disclaimer, the term of this patent is extended or adjusted under 35 U.S.C. 154(b) by 156 days.

(21) Appl. No.: 18/823,444

(22) Filed: Sep. 3, 2024

(65) Prior Publication Data

US 2025/0213040 A1 Jul. 3, 2025

(30) Foreign Application Priority Data

Jan. 3, 2024 (TW) ..... 113100400

(51) Int. Cl.
*A47B 88/49* (2017.01)
*A47B 88/50* (2017.01)

(52) U.S. Cl.
CPC ..... *A47B 88/49* (2017.01); *A47B 88/50* (2017.01); *A47B 2210/0064* (2013.01)

(58) Field of Classification Search
CPC ..... A47B 88/49; A47B 88/50; A47B 88/70; A47B 88/75; A47B 2210/0064; H05K 5/0208; H05K 7/1411
See application file for complete search history.

(56) References Cited

U.S. PATENT DOCUMENTS

| | | | | |
|---|---|---|---|---|
| 1,993,477 | A * | 3/1935 | Gourley | A47B 63/02 312/301 |
| 4,925,257 | A | 5/1990 | Frederiksen et al. | |
| 6,722,749 | B1 | 4/2004 | Pagac | |
| 9,173,488 | B1 * | 11/2015 | Bello | A47B 88/70 |
| 10,750,863 | B2 | 8/2020 | Nugent | |
| 12,364,331 | B2 * | 7/2025 | Chen | A47B 88/45 |
| 2008/0111455 | A1 * | 5/2008 | Fitz | A47B 88/457 312/215 |
| 2012/0187816 | A1 | 7/2012 | Chen et al. | |
| 2018/0031037 | A1 * | 2/2018 | Chen | F16C 29/10 |

(Continued)

*Primary Examiner* — Daniel J Rohrhoff
(74) *Attorney, Agent, or Firm* — Best & Flanagan LLP

(57) ABSTRACT

A slide rail mechanism includes a carried object, a first slide rail assembly, a second slide rail assembly and a locking member. The first slide rail assembly includes a first rail configured to be mounted to a rack, and a second rail configured to carry the carried object. The second slide rail assembly includes a third rail arranged on the carried object, and a fourth rail movable relative to the third rail. The locking member is movably mounted on the carried object. During a process of the second rail being moved relative to the first rail along an opening direction to an extended position, the locking member is moved from a first predetermined position to a second predetermined position, such that a locking part of the locking member is configured to prevent the fourth rail from being moved along the opening direction.

20 Claims, 13 Drawing Sheets

(56) References Cited

U.S. PATENT DOCUMENTS

| | | | | |
|---|---|---|---|---|
| 2018/0049562 | A1* | 2/2018 | Rosner | A47F 5/0025 |
| 2019/0021495 | A1* | 1/2019 | Nugent | A47B 88/80 |
| 2023/0309256 | A1* | 9/2023 | Lin | H05K 7/1411 |
| 2023/0349197 | A1* | 11/2023 | Müller | E05B 65/463 |
| 2024/0215721 | A1* | 7/2024 | Xi | A47B 88/453 |

* cited by examiner

SLIDE RAIL MECHANISM

BACKGROUND OF THE INVENTION

1. Field of the Invention

The present invention relates to a slide rail mechanism, and more particularly, to a slide rail mechanism applicable to a rack.

2. Description of the Prior Art

U.S. Pat. No. 4,925,257 discloses a piece of furniture having a cabinet with two drawers. Each drawer is slidable relative to the cabinet between an open position and a closed position. The piece of furniture comprises a lock bar mounted to the cabinet and configured to be moved between a first position and a second position. The lock bar is configured to interact with a cooperating means mounted to the drawer for preventing the two drawers from being simultaneously moved from the closed position to the open position.

U.S. Pat. No. 6,722,749 B1 discloses a drawer open position controller comprising a ramp, a blocking device and a locking member arranged on the cabinet. When the bottom drawer is pulled out of the cabinet, a follower drives the locking member to move, such that other drawers are blocked through the ramp and the blocking device, and can only be pulled out a certain distance.

The aforementioned patents respectively disclose a piece of furniture capable of preventing two drawers from being simultaneously opened, and a drawer open position controller capable of preventing, when a first drawer has been opened, other drawers from being fully opened. However, for different market requirements, it is important to develop various products.

SUMMARY OF THE INVENTION

The present invention provides a slide rail mechanism applicable to a rack.

According to an embodiment of the present invention, a slide rail mechanism is applicable to a rack. The slide rail mechanism comprises a first carried object, a first slide rail assembly, a second slide rail assembly and a locking member. The first slide rail assembly comprises a first rail and a second rail longitudinally movable relative to the first rail. The first rail is configured to be mounted to the rack, and the second rail is configured to carry the first carried object. The second slide rail assembly is arranged on the first carried object. The second slide rail assembly comprises a third rail and a fourth rail longitudinally movable relative to the third rail. The third rail is configured to be mounted to the first carried object, and the fourth rail is configured to carry a second carried object. The locking member is movably mounted to the first carried object. The first rail is arranged with an auxiliary feature, and the locking member is arranged with a predetermined part and a locking part. When the second rail is located at a retracted position relative to the first rail, the auxiliary feature is configured to support the predetermined part to position the locking member at a first predetermined position, such that the locking part of the locking member is not configured to prevent the fourth rail from being moved along an opening direction, in order to allow the second carried object to be moved relative to the first carried object along the opening direction. During a process of the second rail being moved relative to the first rail along the opening direction to an extended position, the locking member is moved from the first predetermined position to a second predetermined position, such that the locking part of the locking member is configured to prevent the fourth rail from being moved along the opening direction, in order to limit a moving distance of the second carried object relative to the first carried object along the opening direction.

According to another embodiment of the present invention, a slide rail mechanism is applicable to a rack. The slide rail mechanism comprises a first carried object, a first slide rail assembly, a second slide rail assembly and a locking member. The first slide rail assembly comprises a first rail and a second rail longitudinally movable relative to the first rail. The first rail is configured to be mounted to the rack, and the second rail is configured to carry the first carried object. The second slide rail assembly is arranged on the first carried object. The second slide rail assembly comprises a third rail and a fourth rail longitudinally movable relative to the third rail. The third rail is configured to be mounted to the first carried object. The locking member is movably mounted to the first carried object. The first rail is arranged with an auxiliary feature, and the locking member is arranged with a predetermined part and a locking part. During a process of the second rail being moved relative to the first rail along an opening direction to an extended position, the auxiliary feature does not support the predetermined part, such that the locking member is moved from a first predetermined position to a second predetermined position, and the locking part of the locking member is configured to prevent the fourth rail from being moved along the opening direction.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
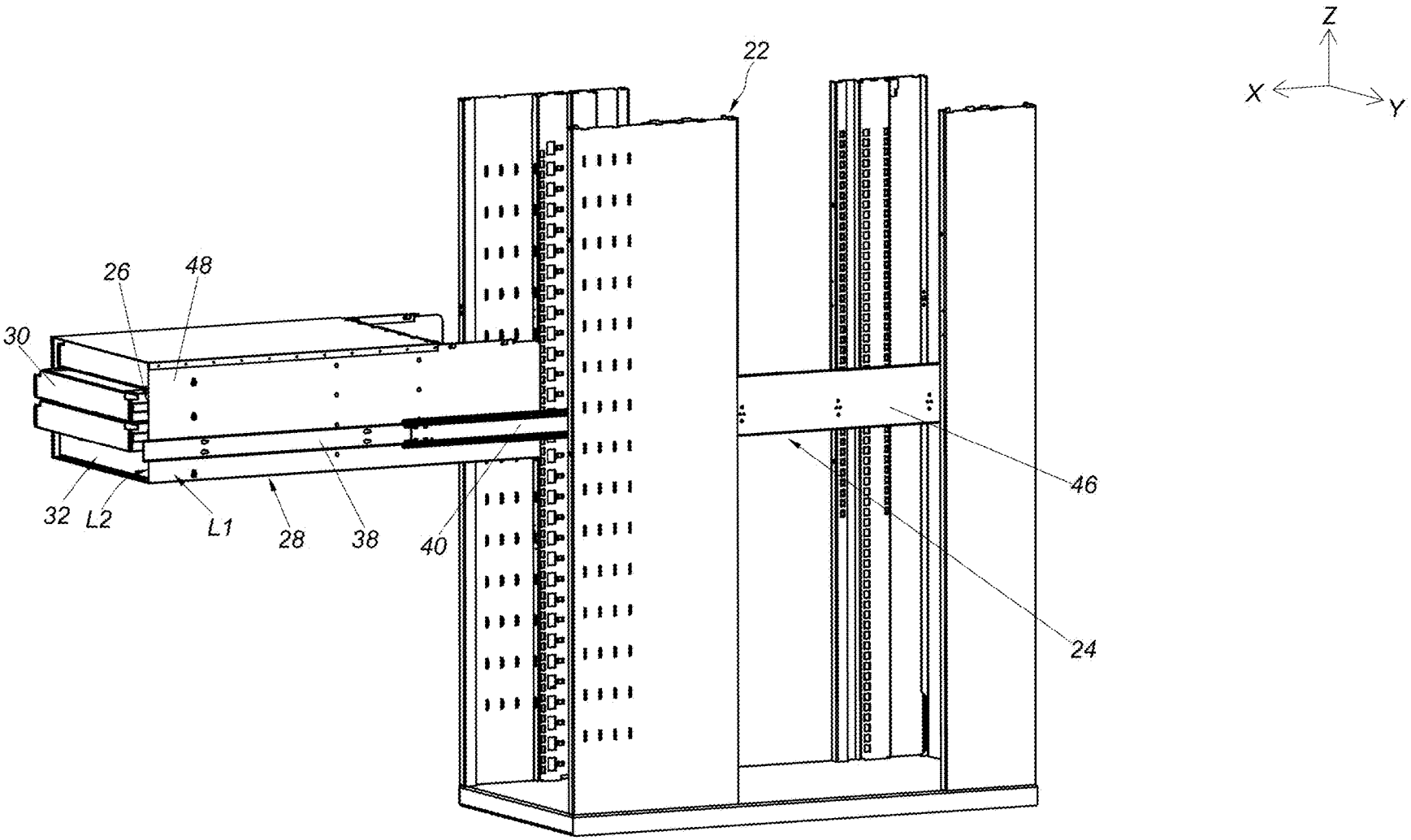
FIG. 1 is a diagram showing a slide rail mechanism applicable to a rack and configured to support a first carried object and at least one second carried object according to an embodiment of the present invention.

As shown in FIG. 1, a slide rail mechanism is applicable to a rack 22 according to an embodiment of the present invention. The slide rail mechanism comprises a first slide rail assembly 24, a second slide rail assembly 26 and a first carried object 28. The first slide rail assembly 24 is configured to support the first carried object 28. For example, the first carried object 28 can be an outer casing. The second slide rail assembly 26 is arranged on the first carried object 28. For example, the second slide rail assembly 26 is arranged at an inner side of the first carried object 28 (the outer casing), and the second slide rail assembly 26 is configured to support a second carried object 30. Preferably, the first carried object 28 is formed with a predetermined space 32 for accommodating the second carried object 30.

Figure 2:
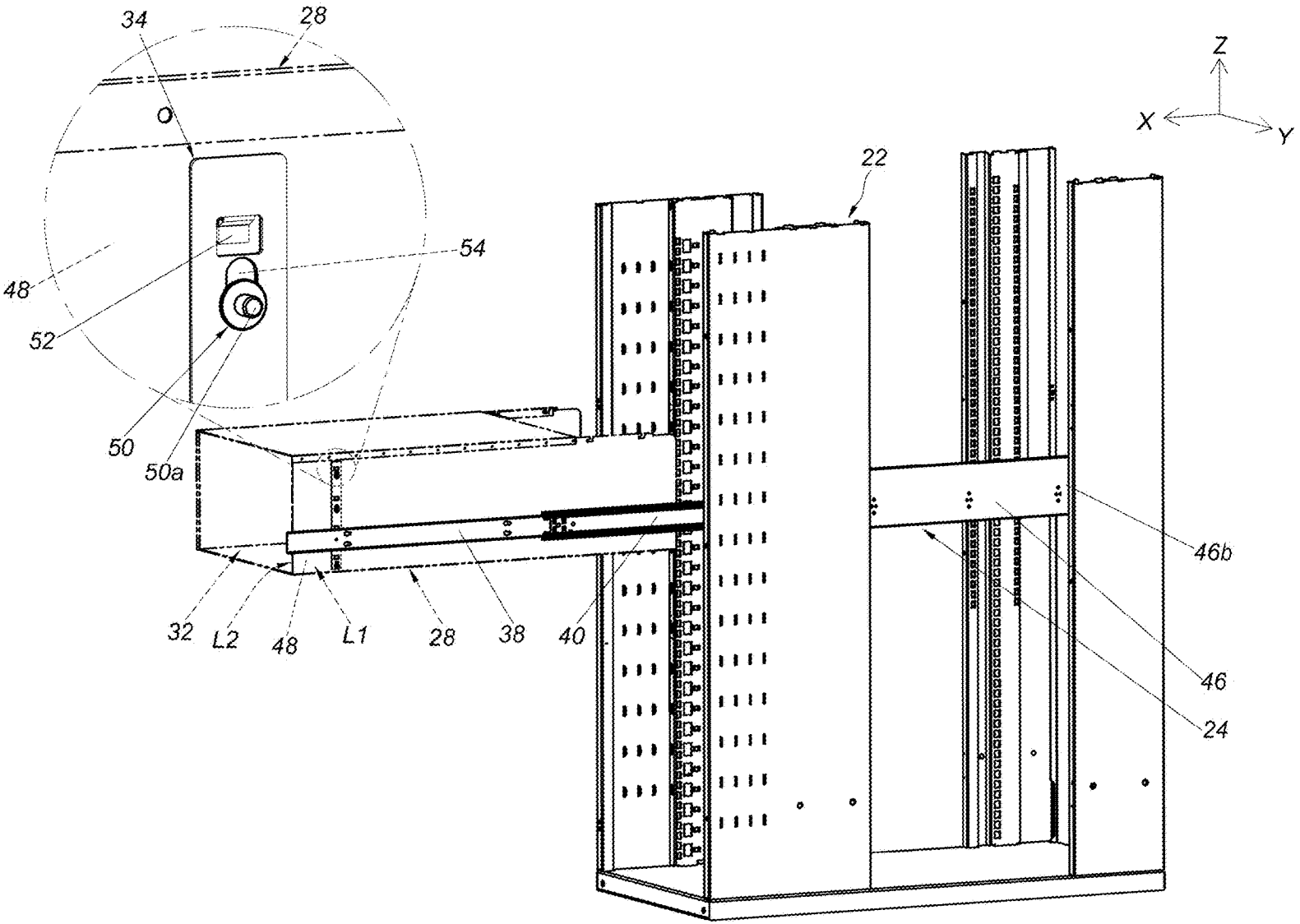
FIG. 2 is a diagram showing the slide rail mechanism applicable to the rack and configured to support the first carried object from a viewing angle according to the embodiment of the present invention.
Figure 3:
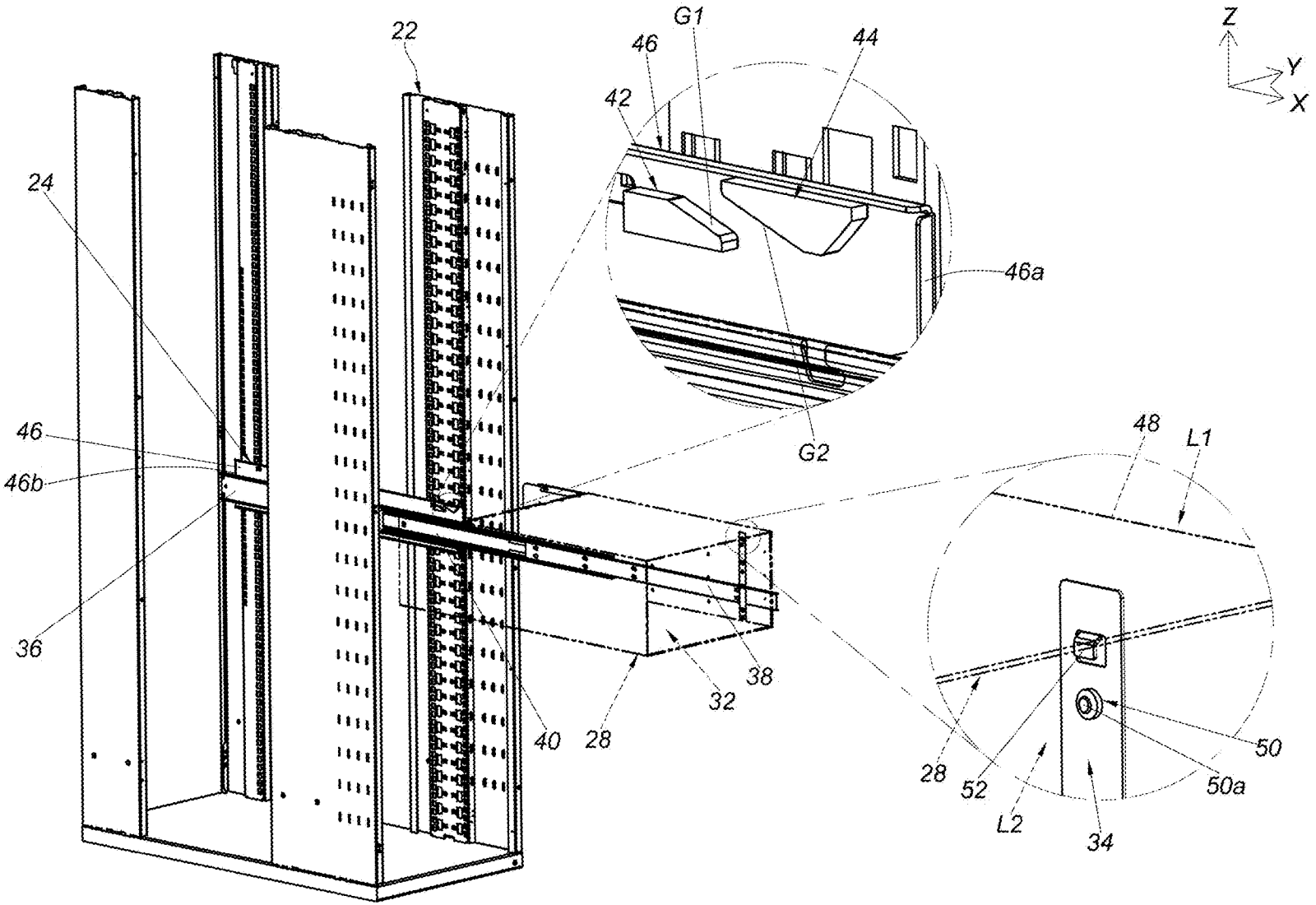
FIG. 3 is a diagram showing the slide rail mechanism applicable to the rack and configured to support the first carried object from another viewing angle according to the embodiment of the present invention.

As shown in FIG. 2 and FIG. 3, the second slide rail assembly 26 and the second carried object 30 are omitted in the figures. Furthermore, the slide rail mechanism further comprises a locking member 34 movably mounted on the first carried object 28.

The first slide rail assembly 24 comprises a first rail 36 and a second rail 38 longitudinally movable relative to the first rail 36. Preferably, the first slide rail assembly 24 further comprises a first middle rail 40 movably mounted between the first rail 36 and the second rail 38. In the present embodiment, the X axis is a longitudinal direction (or a length direction or moving direction of the slide rail), the Y axis is a transverse direction (or a lateral direction of the slide rail), and the Z axis is a vertical direction (or a height direction of the slide rail). The first rail 36 is configured to be mounted to the rack 22, and the second rail 38 is configured to carry the first carried object 28. In addition, the locking member 34 can be a linkage rod, and a moving direction of the locking member 34 is a height direction of the first carried object 28 (such as the Z-axis direction).

The first rail 36 is arranged with a first auxiliary feature 42. Preferably, the first rail 36 is further arranged with a second auxiliary feature 44 (as shown in FIG. 3).

Preferably, the first slide rail assembly 24 further comprises a bracket 46. The first rail 36 is mounted to the rack 22 through the bracket 46. The bracket 46 is connected (such as fixedly connected) to the first rail 36 and can be seen as a portion of the first rail 36.

Preferably, the first auxiliary feature 42 and the second auxiliary feature 44 are arranged on the bracket 46 on the first rail 36. The bracket 46 has a first end part **46*a* and a second end part 46*b* opposite to each other, such as a front end part and a rear end part. The first auxiliary feature 42 and the second auxiliary feature 44 are arranged adjacent to the first end part 46*a* of the bracket 46**, but the present invention is not limited thereto.

Preferably, the first auxiliary feature 42 and the second auxiliary feature 44 are protrusions, and the first auxiliary feature 42 and the second auxiliary feature 44 are spaced apart from each other by a longitudinal distance along the longitudinal direction.

Preferably, the first auxiliary feature 42 and the second auxiliary feature 44 respectively have a first guiding section G1 and a second guiding section G2 corresponding to each other. Each of the first guiding section G1 and the second guiding section G2 has an inclined surface or an arc surface, but the present invention is not limited thereto.

Preferably, the first carried object 28 comprises a plurality of walls. In the present embodiment, the first carried object 28 comprises a predetermined wall 48 (or a side wall). The predetermined wall 48 has a first side L1 and a second side L2 opposite to each other, such as an outer side and an inner side, but the present invention is not limited thereto.

Preferably, the first side L1 of the predetermined wall 48 is connected to the second rail 38, and the predetermined space 32 is formed adjacent to the second side L2.

Preferably, the locking member 34 is arranged with a predetermined part 50 and a locking part 52.

Preferably, the locking member 34 is movably mounted to the second side L2 of the predetermined wall 48 of the first carried object 28. An extension section **50*a* of the predetermined part 50 of the locking member 34 is configured to penetrate through the predetermined wall 48 to extend to the first side L1 (as shown in FIG. 2**).

Preferably, the predetermined wall 48 is formed with a limiting structure 54, such as an oval hole (as shown in FIG. 2), but the present invention is not limited thereto. The extension section **50*a* of the predetermined part 50 is inserted into the limiting structure 54 of the predetermined wall 48, such that the locking member 34 is movable relative to the first carried object 28** within a limited range.

Figure 4:
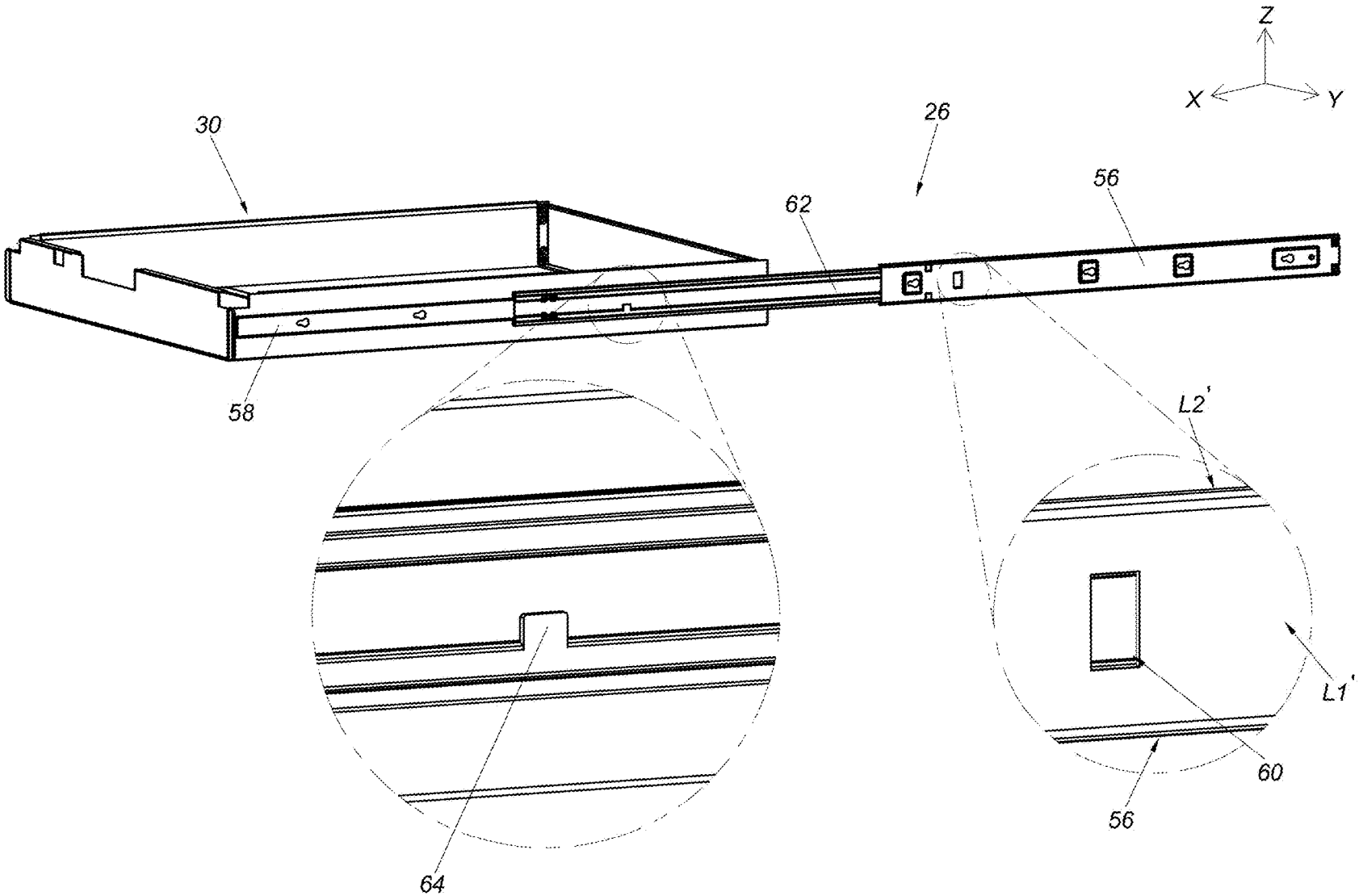
FIG. 4 is a diagram showing a slide rail assembly of the slide rail mechanism configured to support the second carried object according to the embodiment of the present invention.

As shown in FIG. 4, the second slide rail assembly 26 comprises a third rail 56 and a fourth rail 58 longitudinally movable relative to the third rail 56. The third rail 56 is configured to be mounted to the second side L2 of the predetermined wall 48 of the first carried object 28, and the fourth rail 58 is configured to carry the second carried object 30.

Preferably, the third rail 56 has a first side L1' and a second side L2' opposite to each other, such as an outer side and an inner side, but the present invention is not limited thereto. The first side L1' of the third rail 56 is connected to the second side L2 of the first carried object 28, and the second side L2' of the third rail 56 is adjacent to the fourth rail 58. The third rail 56 is formed with an auxiliary space 60 (such as a through hole) communicating the first side L1' and the second side L2' of the third rail 56. The auxiliary space 60 is configured to allow the locking part 52 of the locking member 34 to pass through the third rail 56 from the first side L1' of the third rail 56 to the second side L2' of the third rail 56.

Preferably, the second slide rail assembly 26 further comprises a second middle rail 62 movably mounted between the third rail 56 and the fourth rail 58, and the second middle rail 62 has a blocking feature 64 configured to interact with the locking part 52 of the locking member 34. In the present embodiment, the blocking feature 64 is a protrusion, but the present invention is not limited thereto.

Figure 5:
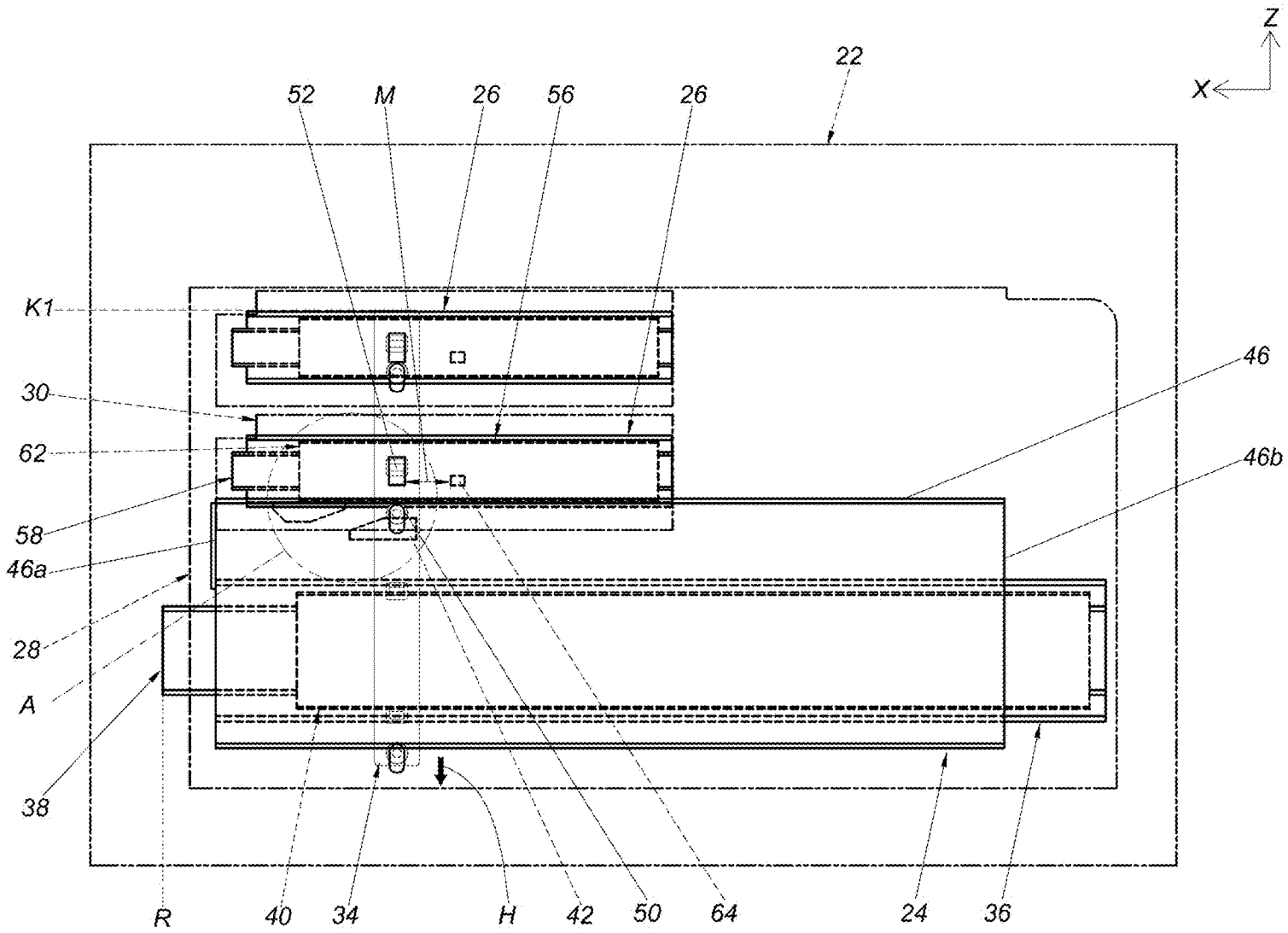
FIG. 5 is a diagram showing the slide rail mechanism applicable to the rack with the first carried object being located at a retracted position, and the second carried object being retracted relative to the first carried object according to the embodiment of the present invention.
Figure 6:
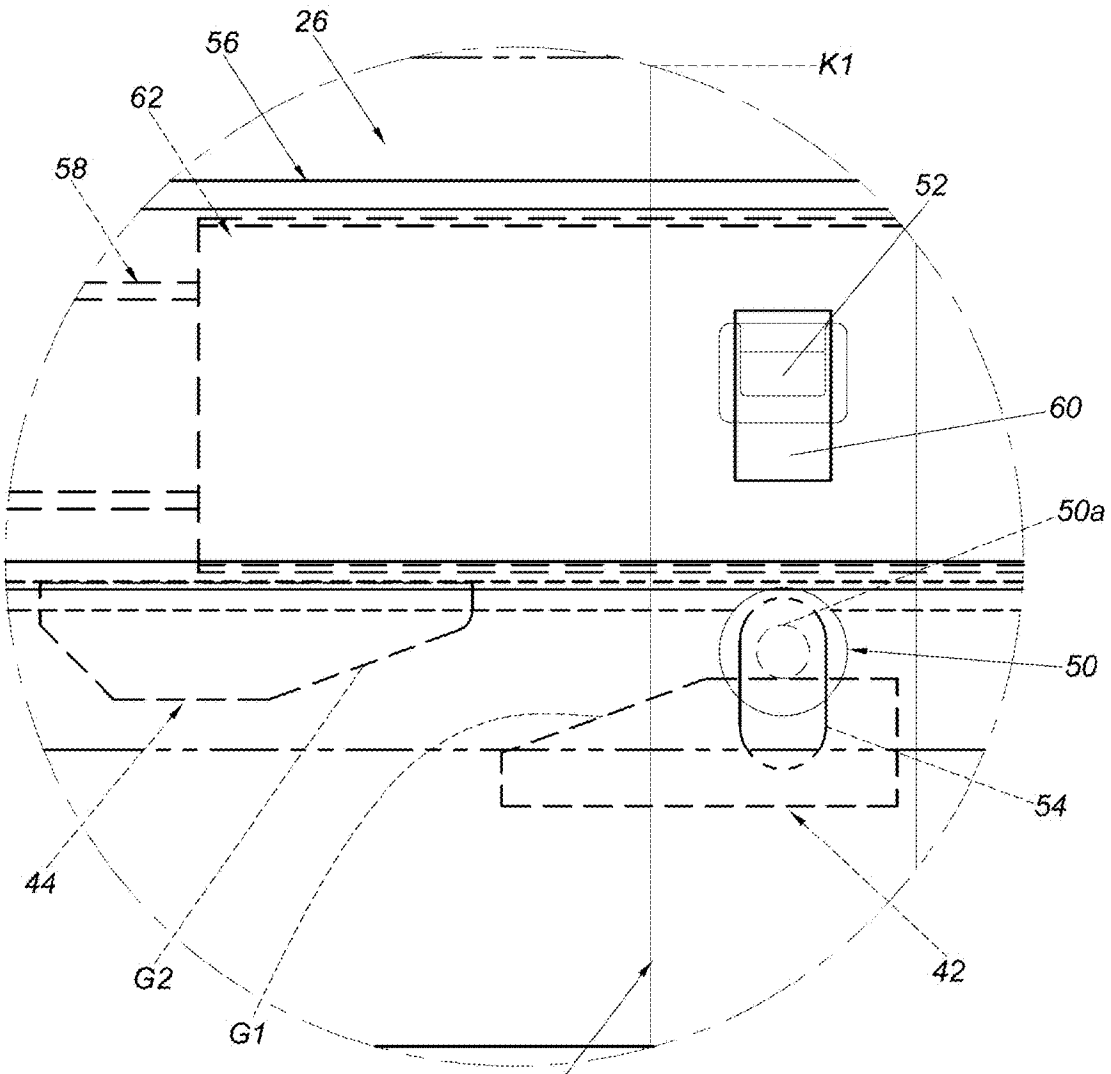
FIG. 6 is an enlarged view of an area A of FIG. 5.

As shown in FIG. 5 and FIG. 6, the first carried object 28 is mounted with a plurality of second slide rail assemblies 26. The second slide rail assemblies 26 have substantially identical structural configuration. The fourth rail 58 of each of the second slide rail assemblies 26 is configured to carry the respective second carried object 30. In addition, the locking part 52 of the locking member 34 passes through the auxiliary space 60 of the third rail 56 to be adjacent to the fourth rail 58 (and the second middle rail 62).

When the second rail 38 is located at a retracted position R relative to the first rail 36, the first auxiliary feature 42 is configured to support the predetermined part 50 (the extension section 50*a* of the predetermined part 50), such that the locking member 34 is positioned at a first predetermined position K1.

Preferably, when the locking member 34 is located at the first predetermined position K1, the locking part 52 of the locking member 34 is not aligned with the blocking feature 64 of the second middle rail 62 along the longitudinal direction. For example, a vertical position of the locking part 52 of the locking member 34 along the vertical direction does not correspond to a vertical position of the blocking feature 64 of the second middle rail 62 along the vertical direction (a transverse position of the locking part 52 of the locking member 34 along the transverse direction corresponds to a transverse position of the blocking feature 64 of the second middle rail 62 along the transverse direction).

Preferably, when the second rail 38 is located at the retracted position R relative to the first rail 36, and when the fourth rail 58 and the second middle rail 62 are retracted relative to the third rail 56, the locking part 52 of the locking member 34 and the blocking feature 64 of the second middle rail 62 are spaced apart from each other by a predetermined longitudinal distance M along the longitudinal direction (as shown in FIG. 5).

Figure 7:
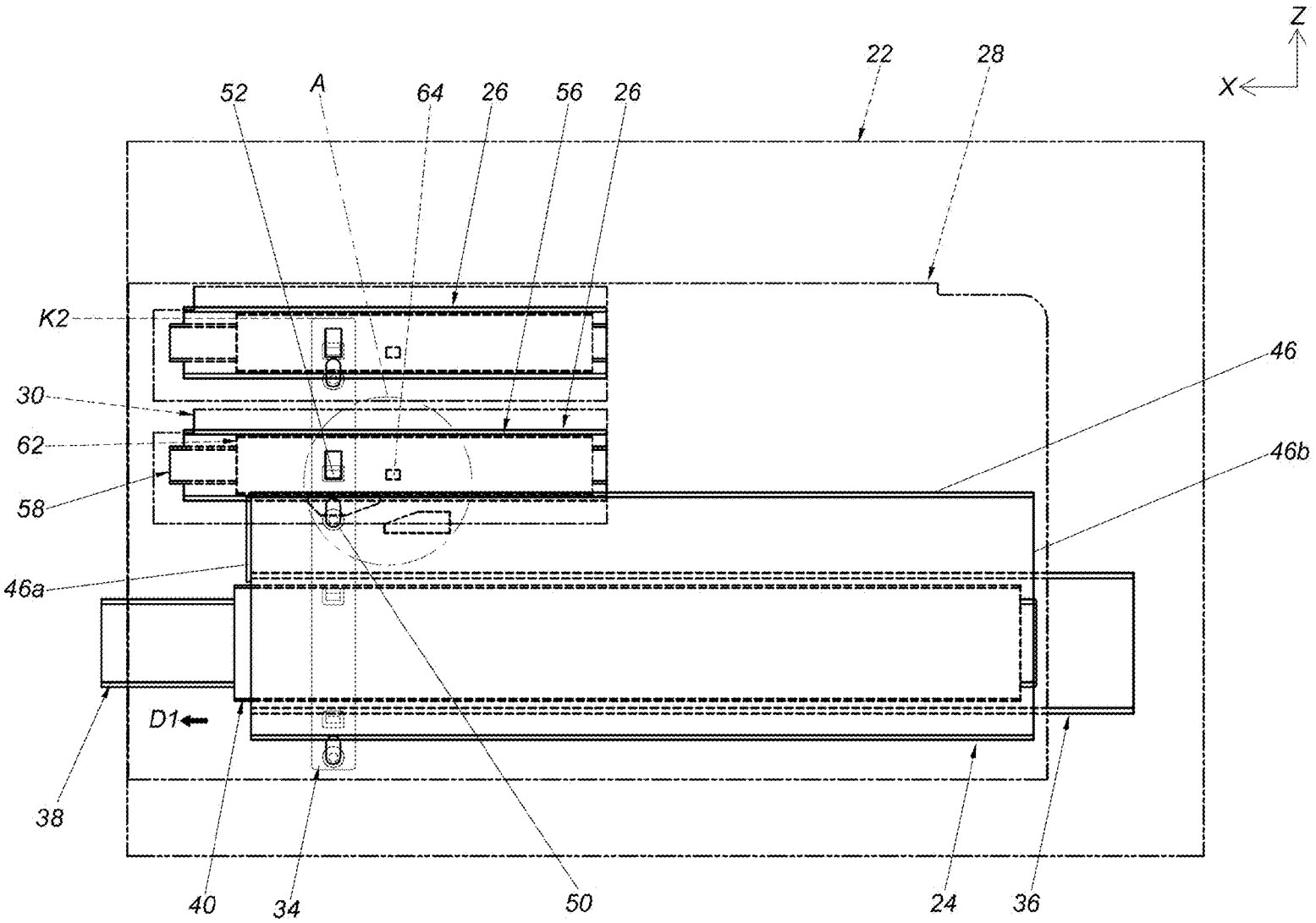
FIG. 7 is a diagram showing the slide rail mechanism applicable to the rack with the first carried object being moved along an opening direction, and the second carried object being retracted relative to the first carried object according to the embodiment of the present invention.
Figure 8:
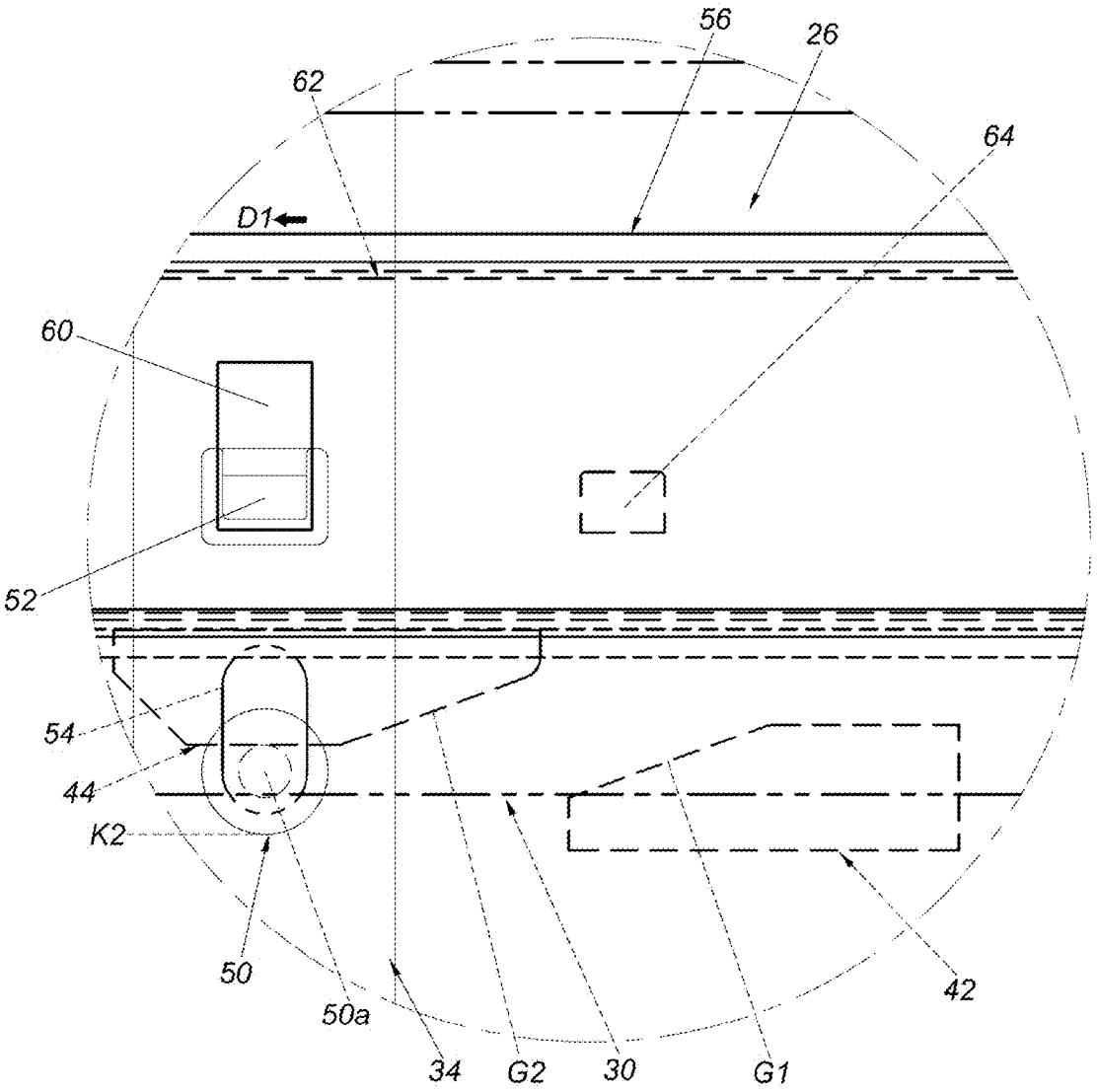
FIG. 8 is an enlarged view of an area A of FIG. 7.
Figure 9:
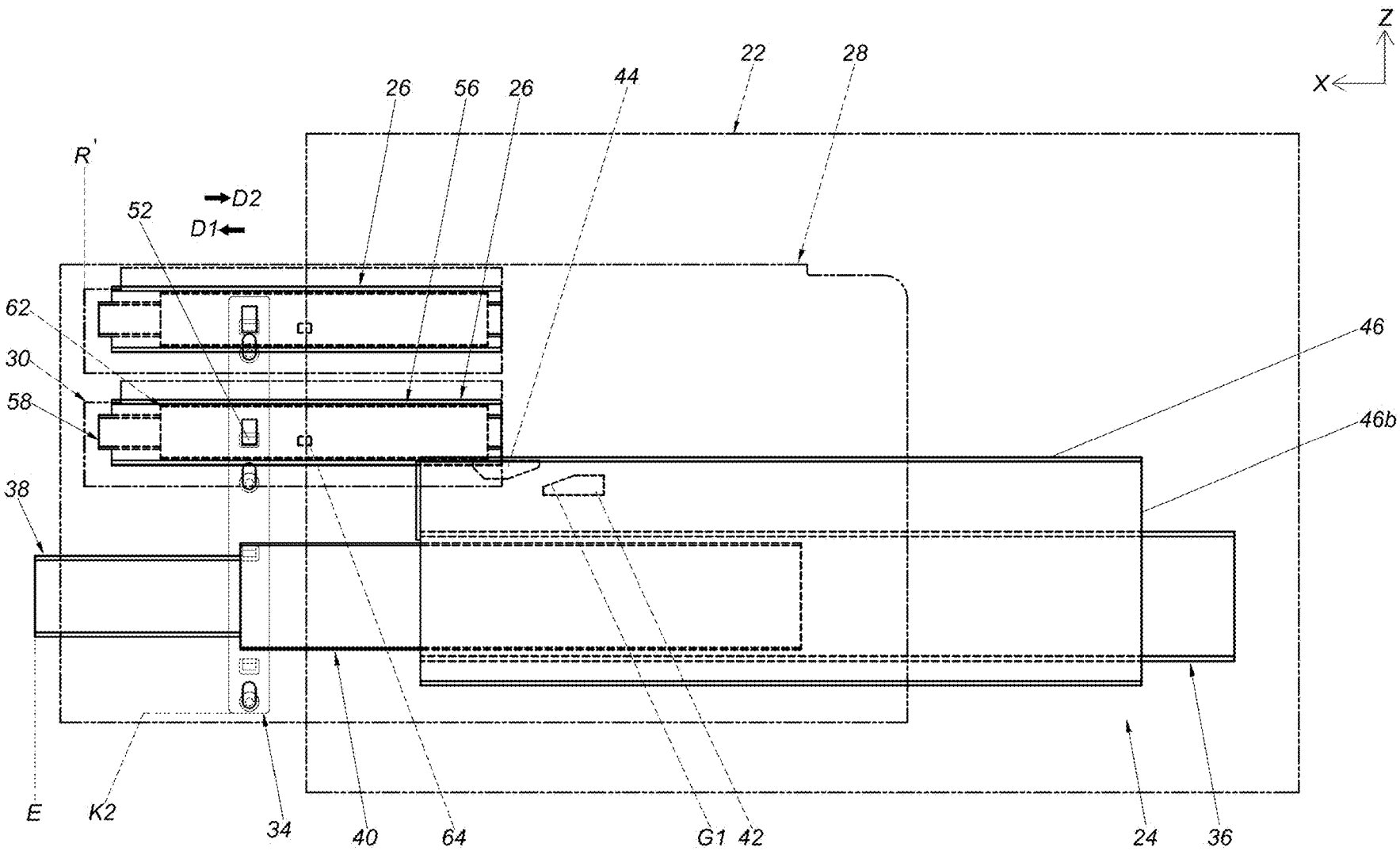
FIG. 9 is a diagram showing the slide rail mechanism applicable to the rack with the first carried object being further moved along the opening direction to an extended position, and the second carried object being retracted relative to the first carried object according to the embodiment of the present invention.

As shown in FIG. 5, FIG. 7, FIG. 8 and FIG. 9, during a process of the second rail 38 being moved relative to the first rail 36 from the retracted position R along an opening direction D1 to an extended position E (as shown in FIG. 9), the first auxiliary feature 42 no longer supports the predetermined part 50, such that the locking member 34 is moved from the first predetermined position K1 along a predetermined height direction H (as shown in FIG. 5) to a second predetermined position K2 (as shown in FIG. 7 and FIG. 8). As such, the locking part 52 of the locking member 34 is configured to prevent the fourth rail 58 from being moved along the opening direction D1 in order to limit a moving distance of the second carried object 30 relative to the first carried object 28 along the opening direction D1.

Preferably, in the present embodiment, the locking part 52 of the locking member 34 is configured to block a moving path of the blocking feature 64 of the second middle rail 62 along the opening direction D1, in order to prevent the fourth rail 58 from being moved along the opening direction D1. Specifically, when the locking member 34 is located at the second predetermined position K2, the locking part 52 of the locking member 34 is aligned with the blocking feature 64 of the second middle rail 62 along the longitudinal direction. Thereby, the second middle rail 62 is configured to indirectly prevent the fourth rail 58 from being moved along the opening direction D1 (for example, a synchronization mechanism is provided between the second middle rail 62 and the fourth rail 58), in order to limit the moving distance of the second carried object 30 relative to the first carried object 28 along the opening direction D1. Moreover, in an alternative embodiment, the second slide rail assembly 26 only comprises the third rail 56 and the fourth rail 58 (that is, the second slide rail assembly 26 does not comprise the second middle rail 62), and the fourth rail 58 is configured to carry the second carried object 30 and has a blocking feature. When the locking member 34 is located at the second predetermined position K2, the locking part 52 of the locking member 34 is aligned with the blocking feature of the fourth rail 58 along the longitudinal direction (a vertical position of the locking part 52 of the locking member 34 along the vertical direction corresponds to a vertical position of the blocking feature of the fourth rail 58 along the vertical direction, and a transverse position of the locking part 52 of the locking member 34 along the transverse direction corresponds to a transverse position of the blocking feature of the fourth rail 58 along the transverse direction), such that the locking member 34 is configured to directly block a moving path of the fourth rail 58 along the opening direction D1, in order to limit the moving distance of the second carried object 30 relative to the first carried object 28 along the opening direction D1.

Preferably, during the process of the second rail 38 being moved relative to the first rail 36 from the retracted position R along the opening direction D1 to the extended position E (as shown in FIG. 9), the second guiding section G2 of the second auxiliary feature 44 is configured to contact and guide the predetermined part 50 (the extension section 50*a* of the predetermined part 50) of the locking member 34 to move the locking member 34 from the first predetermined position K1 (as shown in the FIG. 5) to the second predetermined position K2 (as shown in FIG. 7 and FIG. 8). On the other hand, the locking member 34 can also be moved down to the second predetermined position K2 due to gravity.

Figure 10:
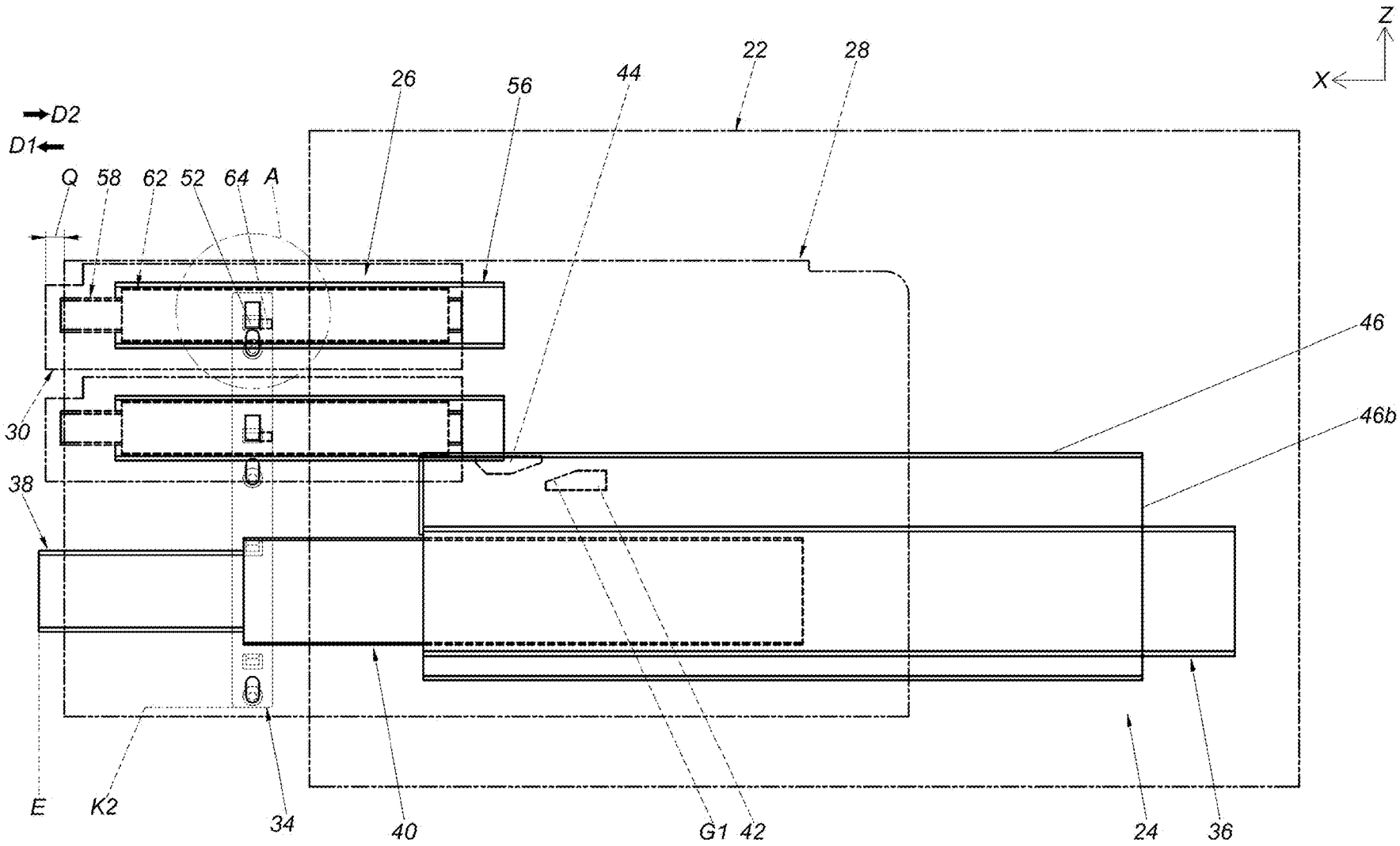
FIG. 10 is a diagram showing the slide rail mechanism applicable to the rack with the first carried object being located at the extended position, and the second carried object being moved relative to the first carried object by a predetermined extension distance according to the embodiment of the present invention.
Figure 11:
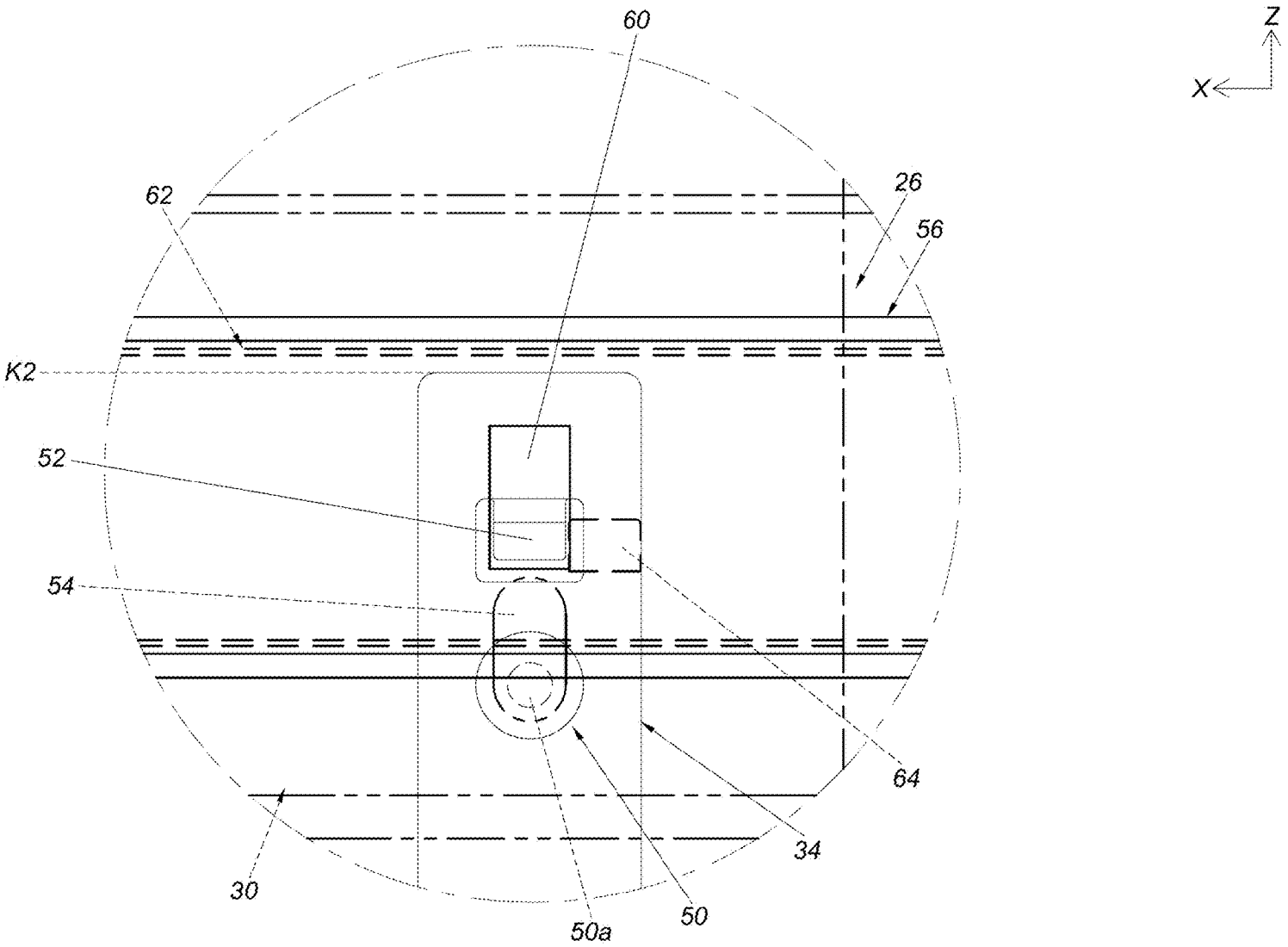
FIG. 11 is an enlarged view of an area A of FIG. 10.

As shown in FIG. 9, FIG. 10 and FIG. 11, when the second rail 38 is located at the extended position E relative to the first rail 36 and when the locking member 34 is located at the second predetermined position K2 (as shown in FIG. 9), the locking part 52 of the locking member 34 and the blocking feature 64 of the second middle rail 62 are aligned with each other along the longitudinal direction to block each other (as shown in FIG. 10 and FIG. 11), so as to indirectly prevent the fourth rail 58 from being moved along the opening direction D1, in order to limit the moving distance of the second carried object 30 relative to the first carried object 28 along the opening direction D1. In the present embodiment, the second carried object 30 is movable relative to the first carried object 28 from a predetermined retracted position R' (as shown in FIG. 9) along the opening direction D1, and only can be pulled out relative to the first carried object 28 by a predetermined extension distance Q (as shown in FIG. 10). Or, in other embodiments, the second carried object 30 is configured to be prevented from being moved relative to the first carried object 28 from the predetermined retracted position R' along the opening direction D1. In other words, the second carried object 30 cannot be fully opened relative to the first carried object 28.

Moreover, during a process of the second rail 38 being moved relative to the first rail 36 from the extended position E (as shown in FIG. 9 and FIG. 10) along a retracting direction D2 to the retracted position R (as shown in FIG. 5 and FIG. 6), the first guiding section G1 of the first auxiliary feature 42 is configured to contact and guide the predetermined part 50 (the extension section 50*a* of the predetermined part 50) of the locking member 34 to move the locking member 34 from the second predetermined position K2 (as shown in the FIG. 9 and FIG. 10) to the first predetermined position K1 (as shown in FIG. 5 and FIG. 6).

Figure 12:
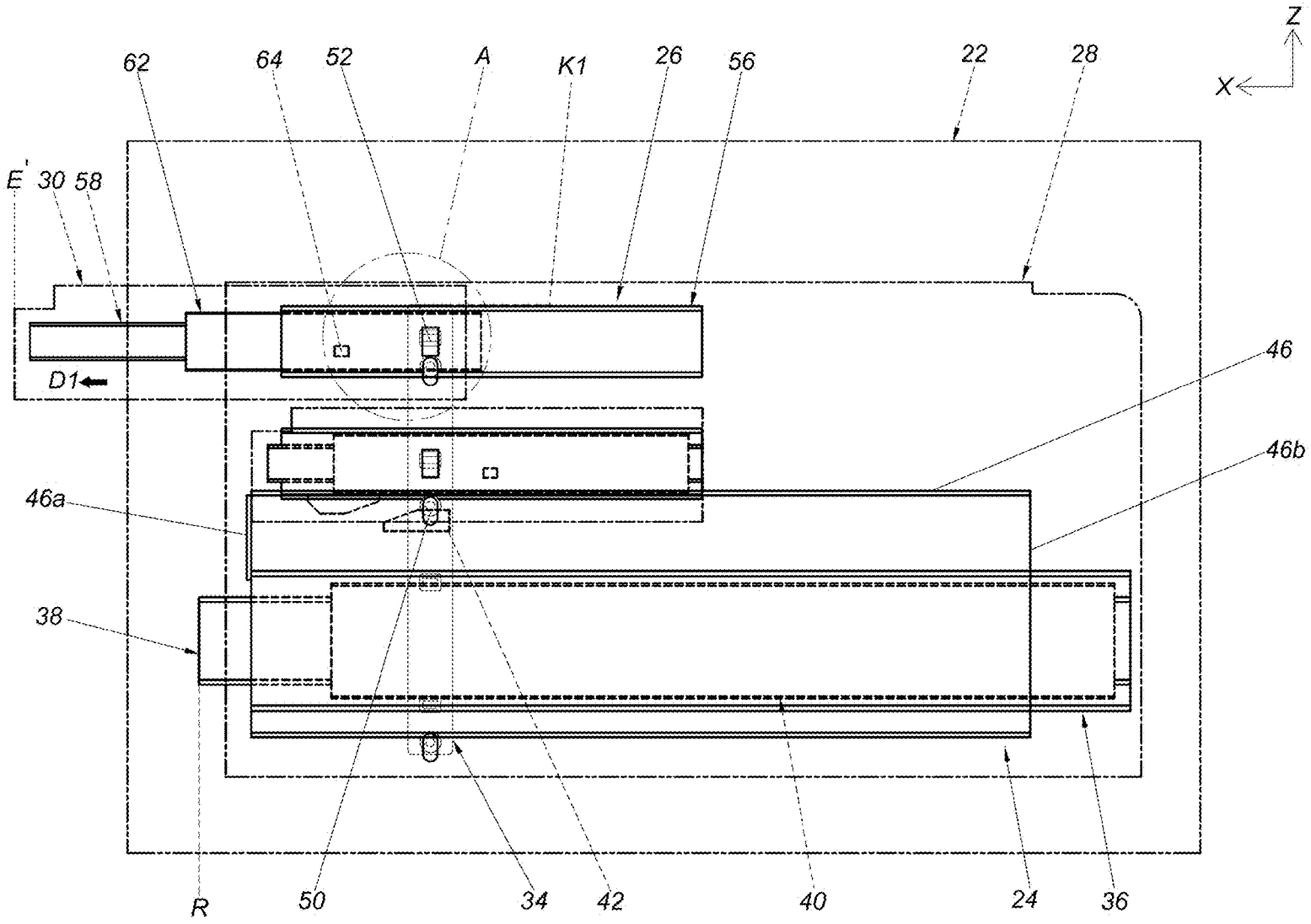
FIG. 12 is a diagram showing the slide rail mechanism applicable to the rack with the first carried object being located at the retracted position, and the second carried object being moved relative to the first carried object along the opening direction to an extended position according to the embodiment of the present invention.
Figure 13:
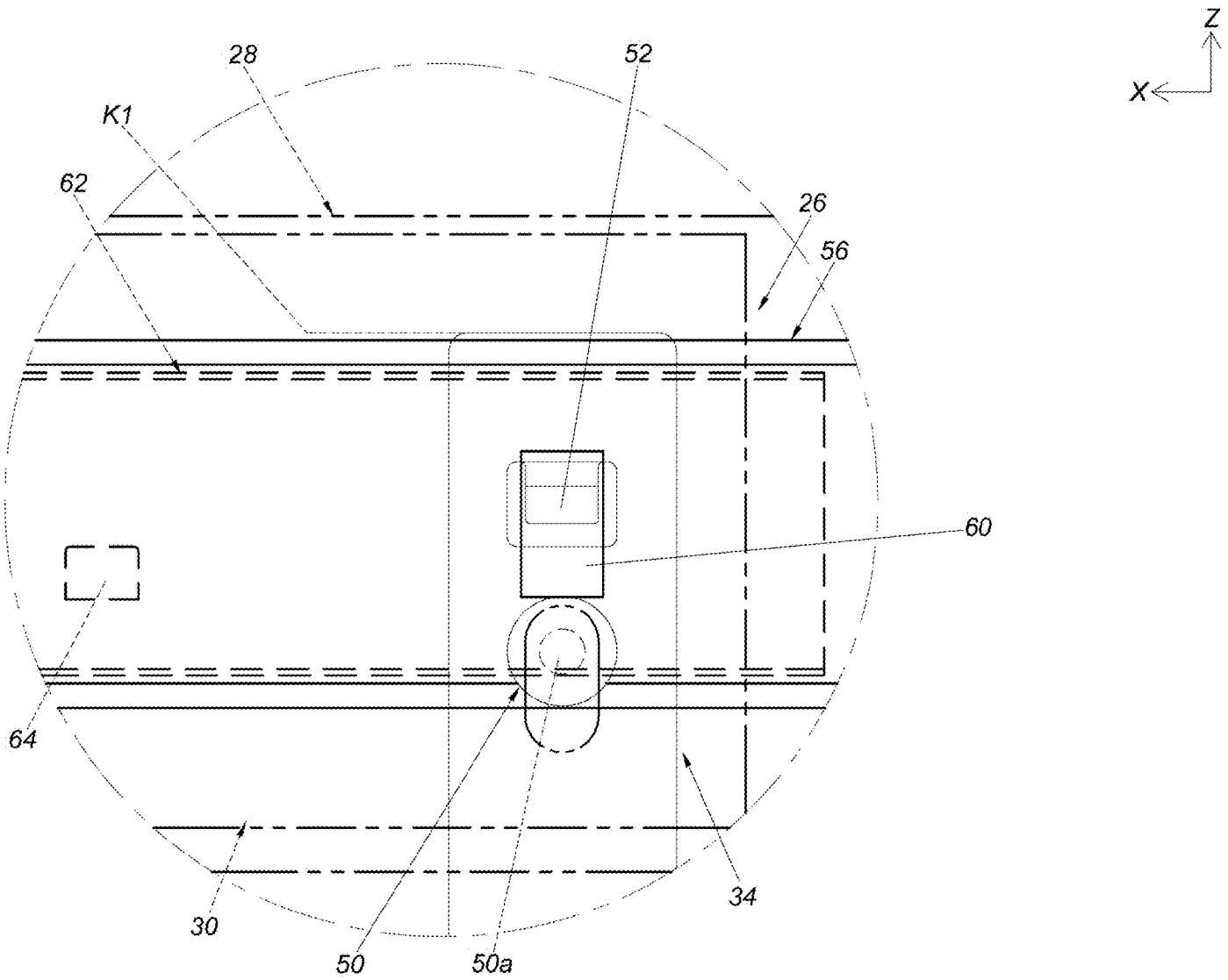
FIG. 13 is an enlarged view of an area A of FIG. 12.

As shown in FIG. 12 and FIG. 13, when the second rail 38 is located at the retracted position R relative to the first rail 36, the first auxiliary feature 42 is configured to support the predetermined part 50 to position the locking member 34 at the first predetermined position K1, such that the locking part 52 of the locking member 34 is not aligned with the blocking feature 64 of the second middle rail 62 along the longitudinal direction. Therefore, the locking part 52 of the locking member 34 is not configured to prevent the fourth rail 58 from being moved along the opening direction D1, in order to allow the second carried object 30 to be moved relative to the first carried object 28 from the predetermined retracted position R' (as shown in FIG. 9) along the opening direction D1 to a predetermined extended position, such as a fully extended position E' (as shown in FIG. 12).

Therefore, the slide rail mechanism according to the embodiments of the present invention has the following technical features:

1. The slide rail mechanism is applicable to a rack, and the locking member 34 is movably mounted on the first carried object 28.
2. When the second rail 38 is located at the extended position E relative to the first rail 36 and when the locking member 34 is located at the second predetermined position K2, the locking part 52 of the locking member 34 is configured to prevent the fourth rail 58 from being moved along the opening direction D1, so as to limit the moving distance of the second carried object 30 relative to the first carried object 28 along the opening direction D1. For example, the second carried object 30 is configured to be prevented from being moved relative to the first carried object 28 from the predetermined retracted position R' (as shown in FIG. 9) along the opening direction D1. Or, the second carried object 30 is movable relative to the first carried object 28 from the predetermined retracted position R' along the opening direction D1, and only can be pulled out relative to the first carried object 28 by the predetermined extension distance Q without being fully opened (as shown in FIG. 10). For example, the second carried object 30 cannot be moved relative to the first carried object 28 from the predetermined retracted position R' along the opening direction D1 to the fully extended position E' (as shown in FIG. 12).
3. When the second rail 38 is located at the retracted position R relative to the first rail 36 and when the locking member 34 is located at the first predetermined position K1, the locking part 52 of the locking member 34 is not configured to prevent the fourth rail 58 from being moved along the opening direction D1, in order to allow the second carried object 30 to be moved relative to the first carried object 28 from the predetermined retracted position R' along the opening direction D1 to the fully extended position E' (as shown in FIG. 12).

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail mechanism applicable to a rack, comprising:

a first carried object;

a first slide rail assembly comprising a first rail and a second rail longitudinally movable relative to the first rail, wherein the first rail is configured to be mounted to the rack, and the second rail is configured to carry the first carried object;

a second slide rail assembly arranged on the first carried object, the second slide rail assembly comprising a third rail and a fourth rail longitudinally movable relative to the third rail, wherein the third rail is configured to be mounted to the first carried object, and the fourth rail is configured to carry a second carried object; and a locking member movably mounted to the first carried object;

wherein the first rail is arranged with an auxiliary feature, and the locking member is arranged with a predetermined part and a locking part;

wherein when the second rail is located at a retracted position relative to the first rail, the auxiliary feature is configured to support the predetermined part to position the locking member at a first predetermined position, such that the locking part of the locking member is not configured to prevent the fourth rail from being moved along an opening direction, in order to allow the second carried object to be moved relative to the first carried object along the opening direction;

wherein during a process of the second rail being moved relative to the first rail along the opening direction to an extended position, the locking member is moved from the first predetermined position to a second predetermined position, such that the locking part of the locking member is configured to prevent the fourth rail from being moved along the opening direction, in order to limit a moving distance of the second carried object relative to the first carried object along the opening direction.

2. The slide rail mechanism of claim 1, wherein the first slide rail assembly further comprises a bracket connected to the first rail, and the first rail is configured to be mounted to the rack through the bracket.

3. The slide rail mechanism of claim 2, wherein the auxiliary feature is arranged on the bracket on the first rail.

4. The slide rail mechanism of claim 2, wherein the first slide rail assembly further comprises a first middle rail movably mounted between the first rail and the second rail.

5. The slide rail mechanism of claim 1, wherein the first carried object comprises a predetermined wall, and the predetermined wall has a first side and a second side opposite to each other; wherein the first side is connected to the second rail, and a predetermined space is formed adjacent to the second side in order to accommodate the second carried object.

6. The slide rail mechanism of claim 5, wherein the locking member is movably mounted to the second side of the predetermined wall of the first carried object; wherein the predetermined part of the locking member is configured to penetrate through the predetermined wall to extend to the first side, and the locking part of the locking member is configured to pass through the third rail to be adjacent to the fourth rail.

7. The slide rail mechanism of claim 6, wherein the second slide rail assembly further comprises a second middle rail movably mounted between the third rail and the fourth rail, and the second middle rail has a blocking feature; wherein when the locking member is located at the second predetermined position, the locking part of the locking member is configured to block a moving path of the blocking feature along the opening direction.

8. The slide rail mechanism of claim 7, wherein when the second rail is located at the retracted position relative to the first rail and when the fourth rail is retracted relative to the third rail, the locking part of the locking member and the blocking feature of the second middle rail are spaced apart from each other by a predetermined longitudinal distance along the longitudinal direction.

9. The slide rail mechanism of claim 6, wherein the predetermined wall is formed with a limiting structure, and the predetermined part of the locking member is inserted into the limiting structure of the predetermined wall.

10. The slide rail mechanism of claim 6, wherein a moving direction of the locking member is a height direction of the first carried object.

11. A slide rail mechanism applicable to a rack, comprising:

a first carried object;

a first slide rail assembly comprising a first rail and a second rail longitudinally movable relative to the first rail, wherein the first rail is configured to be mounted to the rack, and the second rail is configured to carry the first carried object;

a second slide rail assembly arranged on the first carried object, the second slide rail assembly comprising a third rail and a fourth rail longitudinally movable relative to the third rail, wherein the third rail is configured to be mounted to the first carried object; and a locking member movably mounted to the first carried object;

wherein the first rail is arranged with an auxiliary feature, and the locking member is arranged with a predetermined part and a locking part;

wherein during a process of the second rail being moved relative to the first rail along an opening direction to an extended position, the auxiliary feature does not support the predetermined part, such that the locking member is moved from a first predetermined position to a second predetermined position, and the locking part of the locking member is configured to prevent the fourth rail from being moved along the opening direction.

12. The slide rail mechanism of claim 11, wherein when the second rail is located at a retracted position relative to the first rail, the auxiliary feature is configured to support the predetermined part to locate the locking member at the first predetermined position, such that the locking part of the locking member is not configured to prevent the fourth rail from being moved along the opening direction.

13. The slide rail mechanism of claim 12, wherein the first slide rail assembly further comprises a bracket connected to the first rail, the first rail is configured to be mounted to the rack through the bracket, and the auxiliary feature is arranged on the bracket on the first rail.

14. The slide rail mechanism of claim 13, wherein the first slide rail assembly further comprises a first middle rail movably mounted between the first rail and the second rail.

15. The slide rail mechanism of claim 11, wherein the first carried object comprises a predetermined wall, the predetermined wall has a first side and a second side, and the first side is connected to the second rail.

16. The slide rail mechanism of claim 15, wherein the locking member is movably mounted to the second side of the predetermined wall of the first carried object; the predetermined part of the locking member is configured to penetrate through the predetermined wall to extend to the first side, and the locking part of the locking member is configured to pass through the third rail to be adjacent to the fourth rail.

17. The slide rail mechanism of claim 16, wherein the second slide rail assembly further comprises a second middle rail movably mounted between the third rail and the fourth rail, and the second middle rail has a blocking feature; wherein when the locking member is located at the second predetermined position, the locking part of the locking member is configured to block a moving path of the blocking feature along the opening direction.

18. The slide rail mechanism of claim 17, wherein when the second rail is located at the retracted position relative to the first rail and when the fourth rail is retracted relative to the third rail, the locking part of the locking member and the blocking feature of the second middle rail are spaced apart from each other by a predetermined longitudinal distance along the longitudinal direction.

19. The slide rail mechanism of claim 16, wherein the predetermined wall is formed with a limiting structure, and the predetermined part of the locking member is inserted into the limiting structure of the predetermined wall.

20. The slide rail mechanism of claim 16, wherein a moving direction of the locking member is a height direction of the first carried object.

* * * * *